US005450710A

United States Patent [19]

Jensen et al.

[11] Patent Number: 5,450,710

[45] Date of Patent: Sep. 19, 1995

[54] PILL OR CAPSULE CARD FILLING APPARATUS AND METHOD

[76] Inventors: Richard B. Jensen; Jason R. Jensen, both of #20 Point West Blvd., St. Charles, Mo. 63301

[21] Appl. No.: 136,468

[22] Filed: Oct. 13, 1993

[51] Int. Cl.[6] ..... B65B 5/10; B65B 59/00

[52] U.S. Cl. ..... 53/475; 269/309; 248/157

[58] Field of Search ..... 269/231, 235, 309, 310, 269/69, 70; 248/157, 188.2; 53/475, 473, 504, 467

[56] References Cited

U.S. PATENT DOCUMENTS

| | | | |
|---|---|---|---|
| 964,782 | 7/1910 | Hull . | |
| 1,597,246 | 8/1926 | Query . | |
| 1,803,656 | 5/1931 | Schuler . | |
| 2,173,982 | 9/1939 | Schettler | 269/309 X |
| 2,801,025 | 7/1957 | Cookson et al. | 221/203 |
| 2,921,785 | 1/1960 | Underhill | 269/309 X |
| 2,928,364 | 3/1960 | Davis | 269/309 X |
| 3,086,639 | 4/1963 | Donofrio | 198/33 |
| 3,181,739 | 5/1965 | Dye | 222/158 |
| 3,281,012 | 10/1966 | Martell | 221/172 |
| 3,545,164 | 12/1970 | Middleton | 53/26 |
| 3,551,673 | 12/1970 | Siegel | 250/69 |
| 3,628,694 | 12/1971 | Nichols | 221/265 |
| 3,692,228 | 9/1972 | Siegel | 229/29 |
| 3,702,103 | 11/1972 | Price et al. | 113/114 |
| 3,913,734 | 10/1975 | Siegel | 206/498 |
| 4,065,000 | 12/1977 | Murton | 214/1 |
| 4,101,284 | 7/1978 | Difiglio et al. | 23/259 |
| 4,289,258 | 9/1981 | Ransom | 222/308 |
| 4,295,409 | 10/1981 | Simpson | 86/31 |
| 4,411,205 | 10/1983 | Rogers | 111/1 |
| 4,436,268 | 3/1984 | Schriever | 248/188.2 |
| 4,446,672 | 5/1984 | Raudat | 53/475 X |
| 4,460,106 | 7/1984 | Moulding, Jr. et al. | 221/1 |
| 4,694,996 | 9/1987 | Siegel | 241/100 |
| 4,730,849 | 3/1988 | Siegel | 283/70 |
| 4,732,411 | 3/1988 | Siegel | 283/75 |
| 4,750,315 | 6/1988 | Wadell | 53/475 |
| 4,776,150 | 10/1988 | Siegel | 53/329 |
| 4,834,264 | 5/1989 | Siegel et al. | 221/200 |
| 5,107,775 | 4/1992 | Langlais et al. | 248/157 X |
| 5,129,611 | 7/1992 | Grover et al. | 248/157 X |

*Primary Examiner*—Horace M. Culver
*Attorney, Agent, or Firm*—Heller & Kepler

[57] ABSTRACT

A variable height support structure is provided for use in combination with a solid object dispenser such as a pill or capsule dispenser. The height of the support structure is varied by the use of asymmetrical cam designed to move the support structure surface in discreet units. The apparatus allows a dispenser to fill blister packs with pills or capsules of various shapes and thicknesses without dispenser component reconfiguration or modification or replacement.

19 Claims, 18 Drawing Sheets

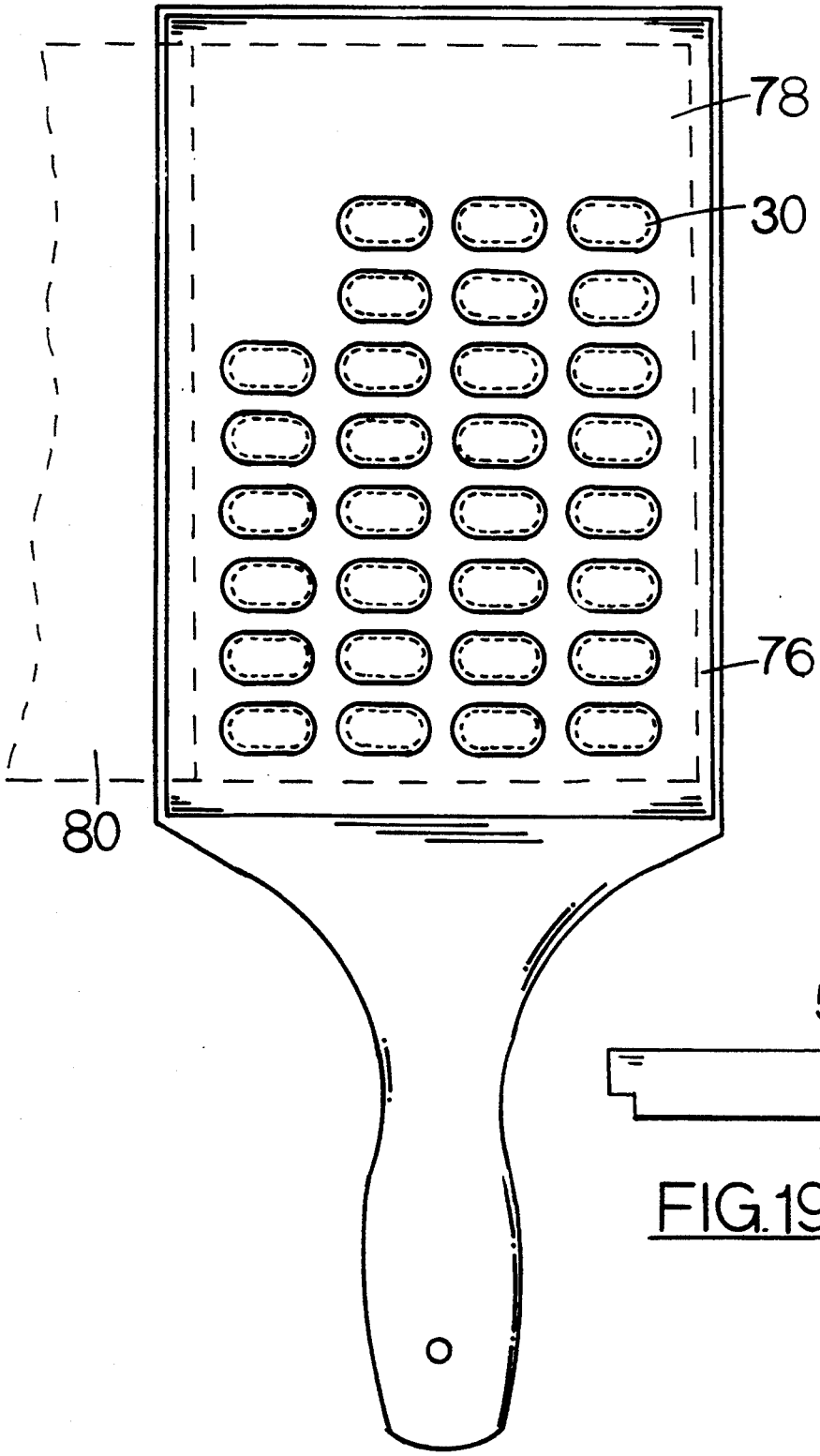
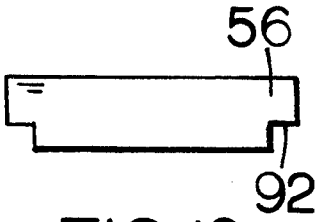
FIG.19
FIG.20

PILL OR CAPSULE CARD FILLING APPARATUS AND METHOD

BACKGROUND OF THE INVENTION

The present invention relates in general to a variable height support apparatus and more specifically to a variable height support apparatus for use in combination with a solid object dispenser such as a pill or capsule dispenser. The variable height support of this invention is an improvement in that it allows a dispenser for filling blister packs with pills or capsules to be easily modified to dispense pills or capsules of various thicknesses without reconfiguration or modification of the dispenser apparatus.

With the conventional pill or capsule card filling apparatus it is generally necessary to modify or reconfigure the apparatus whenever changing the size, and particularly the thickness of the pills or capsules to be placed in the receptacle portions of the conventional pill or capsule card or blister pack.

Blister packs, consisting of a molded semi-rigid base covered and sealed by a rupturable material, are commonly used for packaging pills and capsules. Blister packs are used both by pharmaceutical companies which manufacture the drugs and package them in blister packs, and by smaller health care facilities which use the blister packs for packaging individual doses. These blister packs are also manufactured by companies in the business of providing unfilled blister packs for filling by third parties.

Many conventional dispensers are manufactured to dispense only one size or shape of pill or capsule. Such dispensers are commonly used by pharmaceutical companies which are geared to produce the filled pill or capsule cards or blister packages in large quantities for a particular pill or capsule.

However, for smaller manufacturers or health care facilities it is desirable to be able to produce and fill the cards or blister packages with pills or capsules of various sizes and shapes and use a minimum number of different dispenser. A single, easily modified dispenser is particularly suited to this portion of the industry.

Conventional dispensers are available which can be modified to dispense pills or capsules of varying shapes and sizes. However, these conventional dispensers do not include the improvements included in the present invention as described more fully herein and illustrated in the accompanying drawings.

SUMMARY OF THE INVENTION

Accordingly, it is an object of the present invention to provide a pill or capsule dispensing support structure in which the height of pill or capsule guiding or transfer member of the structure is easily varied.

Another object of the present invention is to provide a support structure in which the height of the aforementioned structure is varied in 1/32" units.

A further object of the present invention is to provide a variable height support structure which is economically constructed with a minimum of parts to avoid expensive repair or replacement.

Still another object of the present invention is to provide a variable height support structure which is suitable for use in combination with a solid object dispenser.

Still a further object of the present invention is to provide a dispenser capable of filling blister packs with pills or capsules of various thicknesses by simply turning a knob.

To accomplish the foregoing and other objects of this invention there is provided a variable height support structure for use in combination with a dispenser. The variable height support structure comprises a work surface supported by an asymmetrical cam, the cam and corresponding axle being supported by a pillow block. The axle protrudes beyond the support structure and includes an end knob to facilitate turning.

When the knob is turned, a different portion of the asymmetric cams are presented to their respective contact portions of the work surface, resulting in movement of the work surface up or down. The cams are preferably designed to move the work surface in increments of 1/32", corresponding to the standard variation in pill or capsule thickness. The cams are held in place at the stated increments by an indexing device comprising a spring-loaded ball bearing mounted within the pillow block and semi-spherical recesses on the cam face.

The work surface is held in level vertical alignment with the dispenser by telescoping support members at the corners of the structure.

When used with a dispenser, the height of the work surface is adjusted to correspond to the thickness of the pill or capsule being dispensed. A conventional paddle containing the blister packs to be filled is inserted into the structure and supported by the work surface. Once a blister pack is filled, then the paddle is used to move the blister pack to a heat sealing device.

The dispenser device includes a bin for holding the bulk pills or capsules to be dispensed and rotating brushes to keep the pills in motion. The pills or capsules are swept by the brushes through apertures or openings in a stationary plate which forms the base of the bin.

A spring-loaded shuttle plate which has openings corresponding to the size or thickness and shape of the pill or capsule is positioned underneath the apertures of openings in the stationary plate such that the pills or capsules fall into the openings. The shuttle plate then moves horizontally until the openings are aligned with apertures in a dispensing plate located beneath the shuttle plate.

The dispensing plate includes apertures which are selected to correspond to the shape of the pill or capsule being dispensed. These apertures in the dispensing plate are aligned with the openings in the blister packs. It will be understood that the number of apertures and their arrangement or pattern in the dispensing plate will vary depending upon the number of receptacles and their arrangement in the receiving blister pack.

The blister packs are held in position by a paddle plate. The pills or capsules drop through the dispensing plate and into the blister packs. The paddle with the now filled blister package is removed and replaced with an unfilled blister pack or another paddle with an unfilled blister pack is placed in position within the apparatus of the present invention.

These and other objects and features of the present invention will be better understood and appreciated from the following detailed description of preferred embodiments thereof, selected for purposes of illustration and shown in the accompanying drawings.

BRIEF DESCRIPTION OF THE DRAWINGS

FIG. 16, 17 and 18 are plan views of a plurality of dispensing plates used in the dispenser shown in FIG. 1, wherein FIG. 16 illustrates elongated slots or openings for filling a conventional blister package with 30 or 31 pills or capsules, and FIG. 17 and FIG. 18 illustrate apertured plates for dispensing either 90 relatively small or relatively larger pills or capsules;

FIG. 19 is a typical end view of the dispensing plate illustrating one embodiment of a shoulder arrangement on the sides of the dispensing plate in which the shoulder facilitates the insertion of the dispensing plate into the supporting frame member; and FIG. 20 illustrates a view of a blister pack paddle used in concert with the other plates by an operator of the dispenser structure and supported by the dispenser structure of FIG. 1.

DETAILED DESCRIPTION

Figure 1:
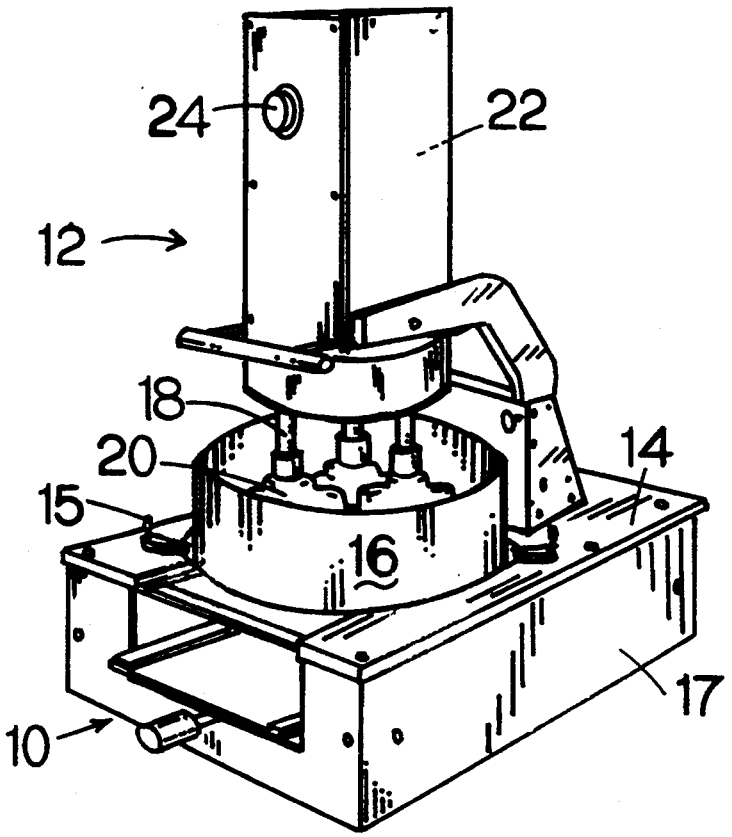
FIG. 1 is a perspective view of the support structure of the present invention in combination with a solid object dispenser.

Referring now to the drawings there is shown a preferred embodiment for the variable height support structure for the dispenser of this invention.

The support structure is described in connection with a solid object dispenser, more particularly a dispenser for dispensing pills or capsules into blister packs. The support structure allows variation of the height of a work surface by use of asymmetric cams supporting the work surface. As the axle bearing the cams is turned, a portion of the cam having a different radius is presented to the work surface. The variation in cam radius results in a variation of the work surface height.

The support structure of the present invention is particularly adapted for use with a pill or capsule dispenser. The location of the adjustable work surface that supports the dispenser plate is determined so as to allow the blister packs to be filled efficiently. It will be understood that the vertical location of the work relative to the shuttle plate surface can be changed as required as the thickness, shape or size of the pill or capsule being dispensed requires.

The support structure of the present invention allows the work surface height to be adjusted in 1/32" increments by turning the axle-mounted knob. This obviates the need to completely disassemble or substantially reconfigure the dispenser to accommodate pills or capsules of varying thicknesses.

The drawings show a preferred embodiment of the variable height support structure generally designated 10 in combination with a solid object dispenser generally designated 12 in FIG. 1.

The presently preferred dispenser 12 has a dispenser base 17 in which the support structure 10 is housed. Base 17 includes a U-shaped cover portion 14 with one or more moveable tabs 15. The cover 14 supports a circular collar 16 which acts as a bin to hold a pill, capsule, pills or capsules to be dispensed. The tabs 15 hold the collar 16 in place.

Mixer rods 18 having brushes 20 rotate to move and mix the pill, capsules, pills or capsules within the collar bin 16 with the rotating brushes. The rods 18 are rotated by a motor 22, and the rotation speed is controlled by the user through a selector 24. It will be understood that a motor driven brush arrangement of this type is conventional.

Figure 10:
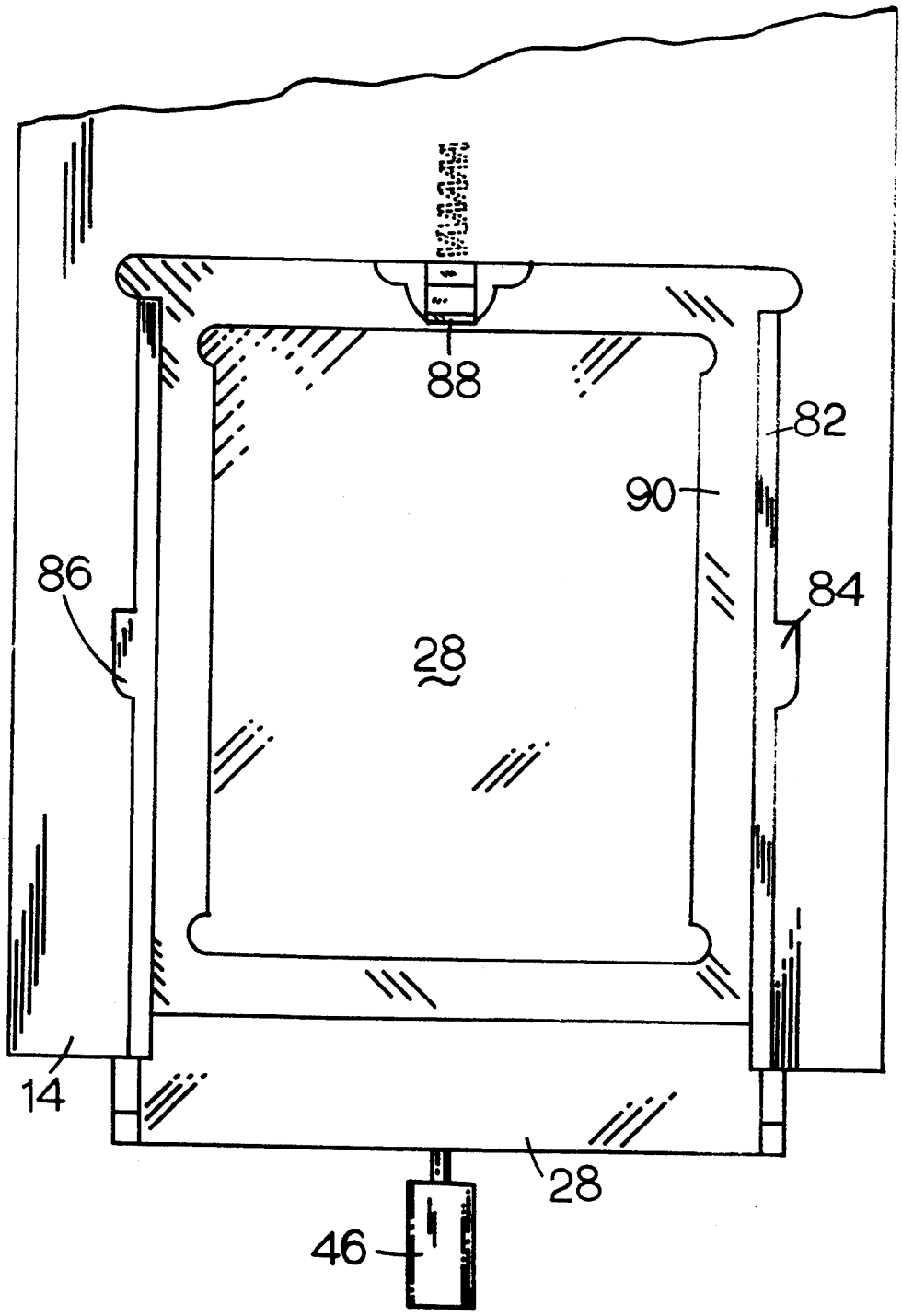
FIG. 10 is a plan view further illustrating the shuttle plate spring device and the dispenser surfaces.

As shown more clearly in FIG. 10, the U-shaped cover 14 has a recessed ledge 82 around its inner perimeter. The ledge 82 further includes two notches 84 and 86 located preferably at the mid-point along each of the "legs" of the U-shaped cover 14. A spring device 88 is mounted on the base portion of the cover 14 and extends horizontally over the recessed ledge 82.

Figure 2:
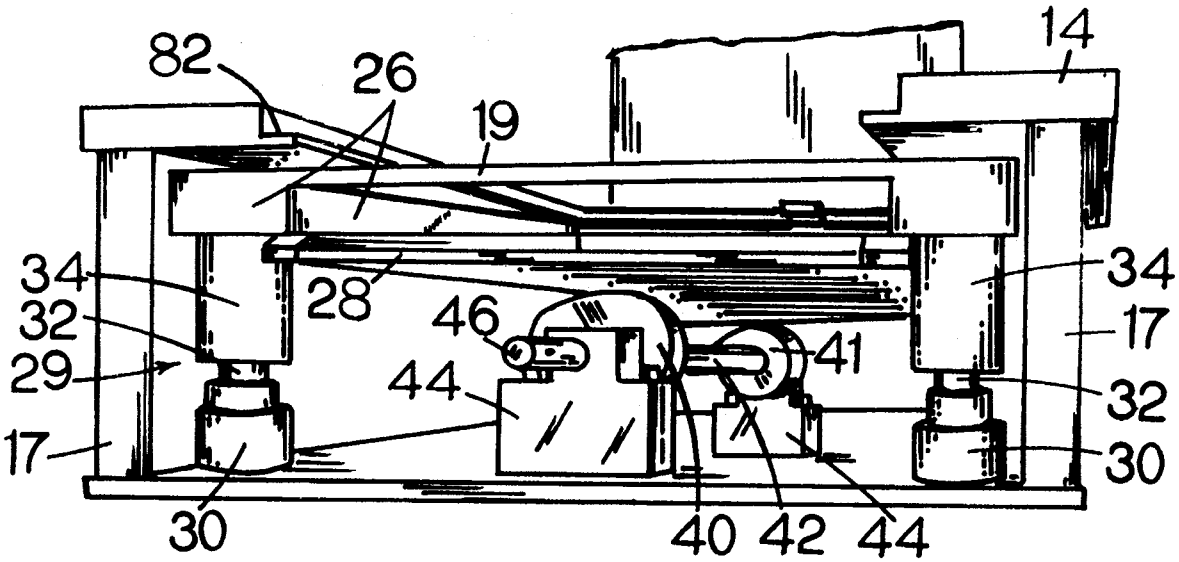
FIG. 2 is a perspective view of the support structure of FIG. 1.

The support structure 10 is shown in more detail in FIG. 2 where the front face of dispenser base 17 has been removed. Structure 10 includes a work surface 28 which is framed by a U-shaped upwardly extending portion 26.

Extending inwardly from the top of the U-shaped extension portion 26 is a second framing portion 90. The work surface 28 is preferably retained in level alignment by telescoping alignment members generally designated 29 located at the four corners of work surface 28.

The alignment members 29 include a guide base 30, an inner telescoping member 32 and an outer telescoping member 34. The alignment members 29 are mounted on a base 36. It will be understood that other alignment arrangements are readily substituted for that shown with the preferred embodiment.

Figure 3:
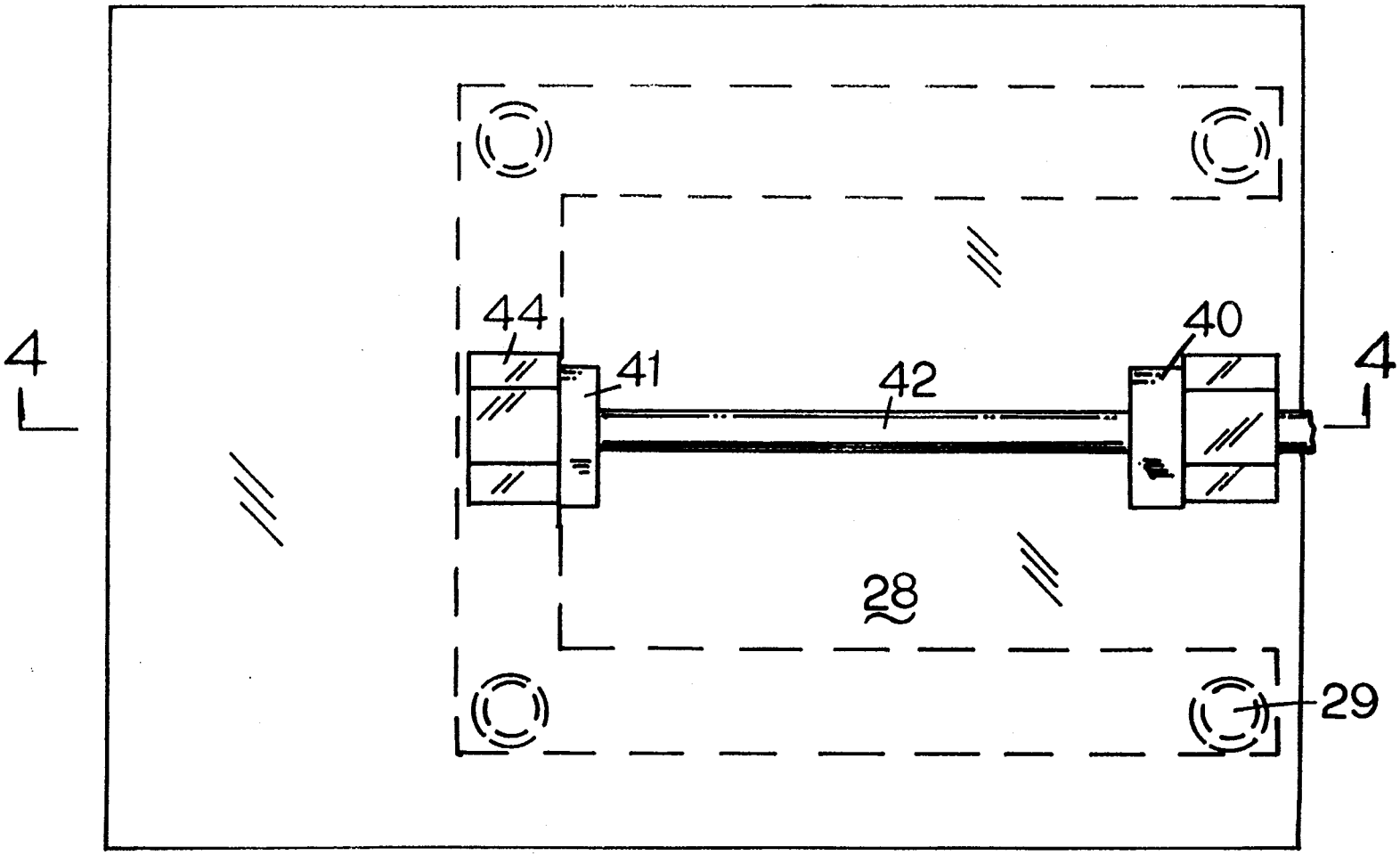
FIG. 3 is a plan view of the support structure FIG. 2 with the work surface in dashed lines to show the cam and axle which vary the height of the work surface.

The work surface 28 rests on the asymmetric cams 40, 41. The work surface 28 is shown in dashed lines in FIG. 3 to illustrate and clarify the location of the cam structure. It will be understood that the actual shape of the cam portion of the cam structure may be altered in the event that more than the ¼" inch adjustment is required. This also underscores the fact that the present invention is not limited to the dispensing of pills or capsules in order to fill blister packs for later dispensing.

Figure 4:
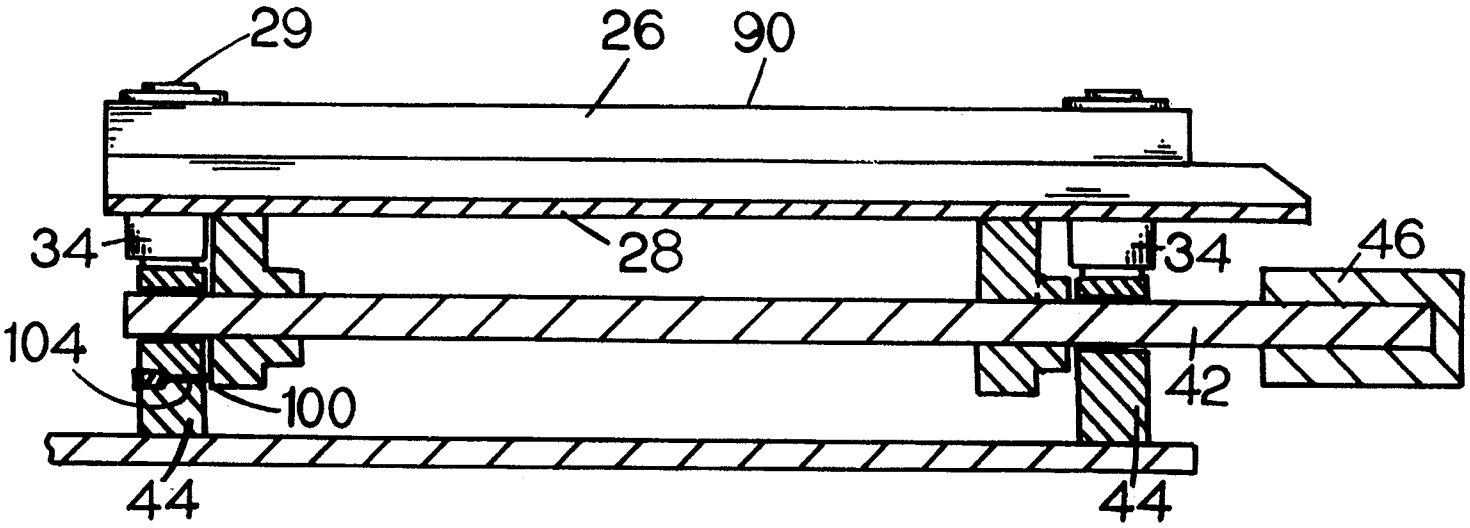
FIG. 4 is a cross section of the structure of FIG. 2 taken along line 4—4 in FIG. 2.

The cams and the corresponding axle 42 are preferably supported by a pillow block 44 mounted to the base 36. A portion of the axle 42 extends beyond the structure 10 and includes a handle or a knob 46 to allow a user to turn the axle 42 and therefore the cams 40, 41. These cams 40, 41 and the axle 42 construction is shown in cross section in FIG. 4.

The cams 40, 41 in the illustrated embodiment are asymmetric in shape. In the presently preferred embodiment one quadrant of both of the cams 40, 41 have a gradually increasing radius, the radius at its longest point being ¼" longer than at its shortest point.

Figure 8:
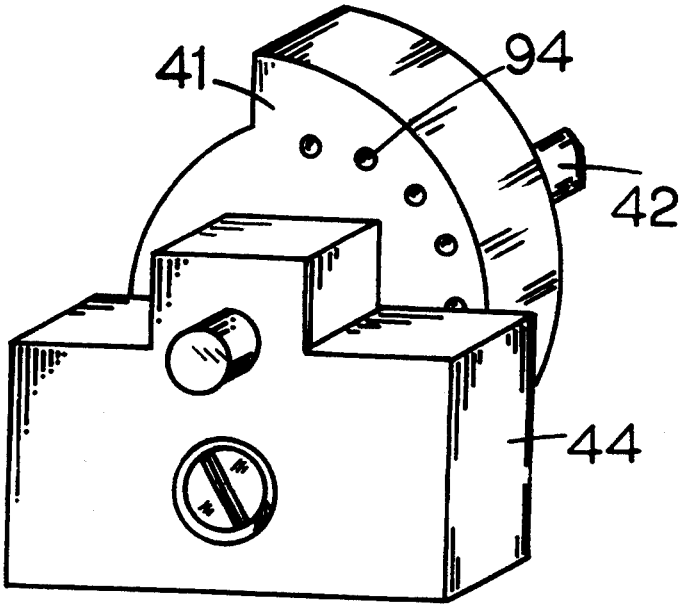
FIG. 8 is a rear perspective view of the cam assembly illustrating the indexing device recesses on the cam face.
Figure 9:
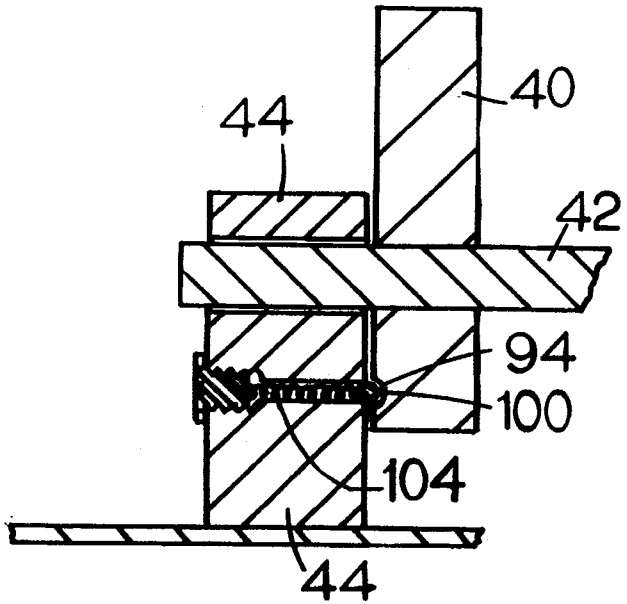
FIG. 9 is a cross sectional view of the cam assembly showing a spring-loaded ball-bearing assembly.

The knob 46 turns the cams so that the radius of cams 40, 41 presented to the work surface increases in discreet 1/32" increments. This corresponds to the industry standard thicknesses of pills and capsules. These increments are accomplished by an indexing device as shown in FIG. 8 and FIG. 9.

The rear cam 41 preferably includes semi-spherical recesses on the rear face of the cam. The portion of the corresponding pillow block adjacent to the cam face or the rear cam includes a spring-loaded ball bearing sized correspondingly to fit within the recesses on the cam face.

As the knob 46 turns the cam 41, the ball-bearing 100 exerts pressure on the cam face. As a cam recess 94 is presented to the ball bearing 100, the spring 104 forces the ball-bearing 100 into the recess 94, "locking" the cam in position. By turning the knob 46 again, the force applied forces the ball bearing 100 back out of the recess 94. The ball bearing 100 then presses against the cam face until another recess 94 is presented.

The nine cam recesses are located in relation to the cam and spring-loaded ball bearing so that each "locked" position corresponds to a 1/32" variation in the cam radius being presented to the work surface.

Figure 5:
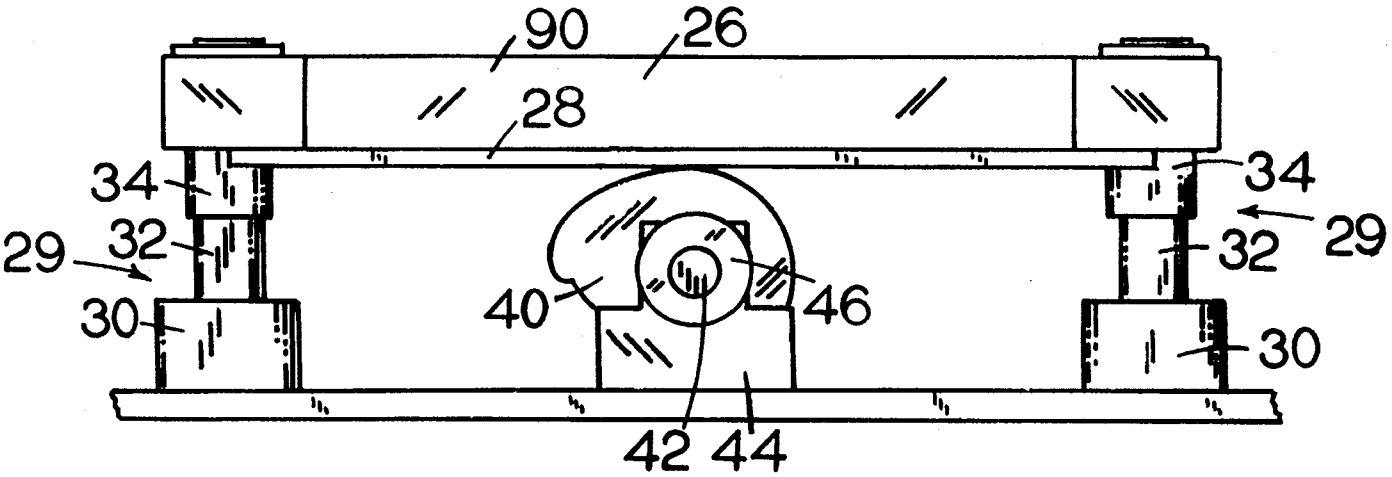
FIG. 5 is a front elevation of the structure of FIG. 2 with the work surface in its lowered position.
Figure 6:
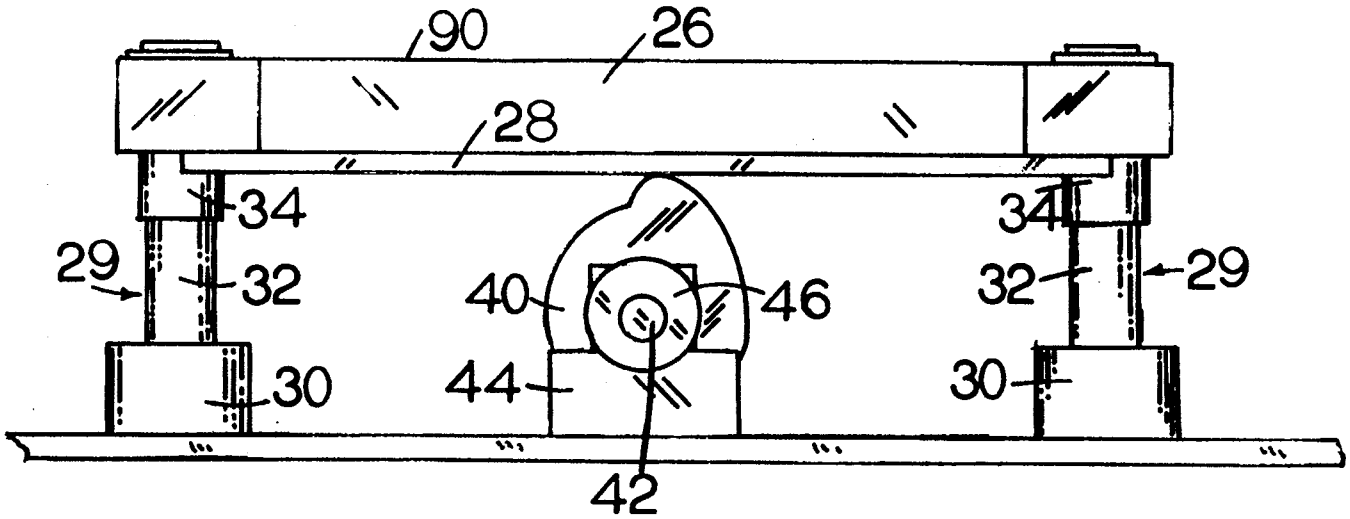
FIG. 6 is a front elevation of the structure of FIG. 2 with the work surface in its raised position.
Figure 7:
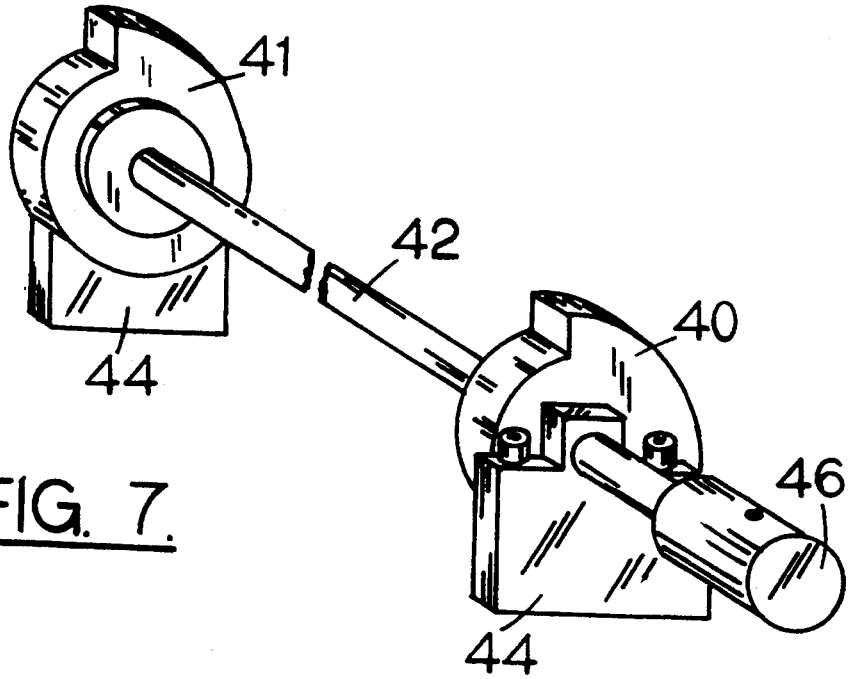
FIG. 7 is a front perspective view of the cam assembly.

FIG. 5 shows the cams 40, 41 positioned so that the shortest radius is presented to and supports work surface 28 so that the work surface 28 is in it lowest position. FIG. 6 shows the cams 40, 41 positioned so that the longest radius is presented to and supports the work surface 28 so that the work surface 28 is in its uppermost position.

In use, the preferred combination dispenser 12 and the support structure 10 includes a desired number of replaceable plates and four replaceable plates are illustrated, each selected for a particular application. The uppermost plate 50, shown in FIGS. 11 and 12, as preferred for the described embodiment, is octagonal and forms the base of the bin 16. Plate 50 includes one or more apertures 52 through which the pill, pills, capsules or pills are swept by the rotating brushes 20.

Figure 11:
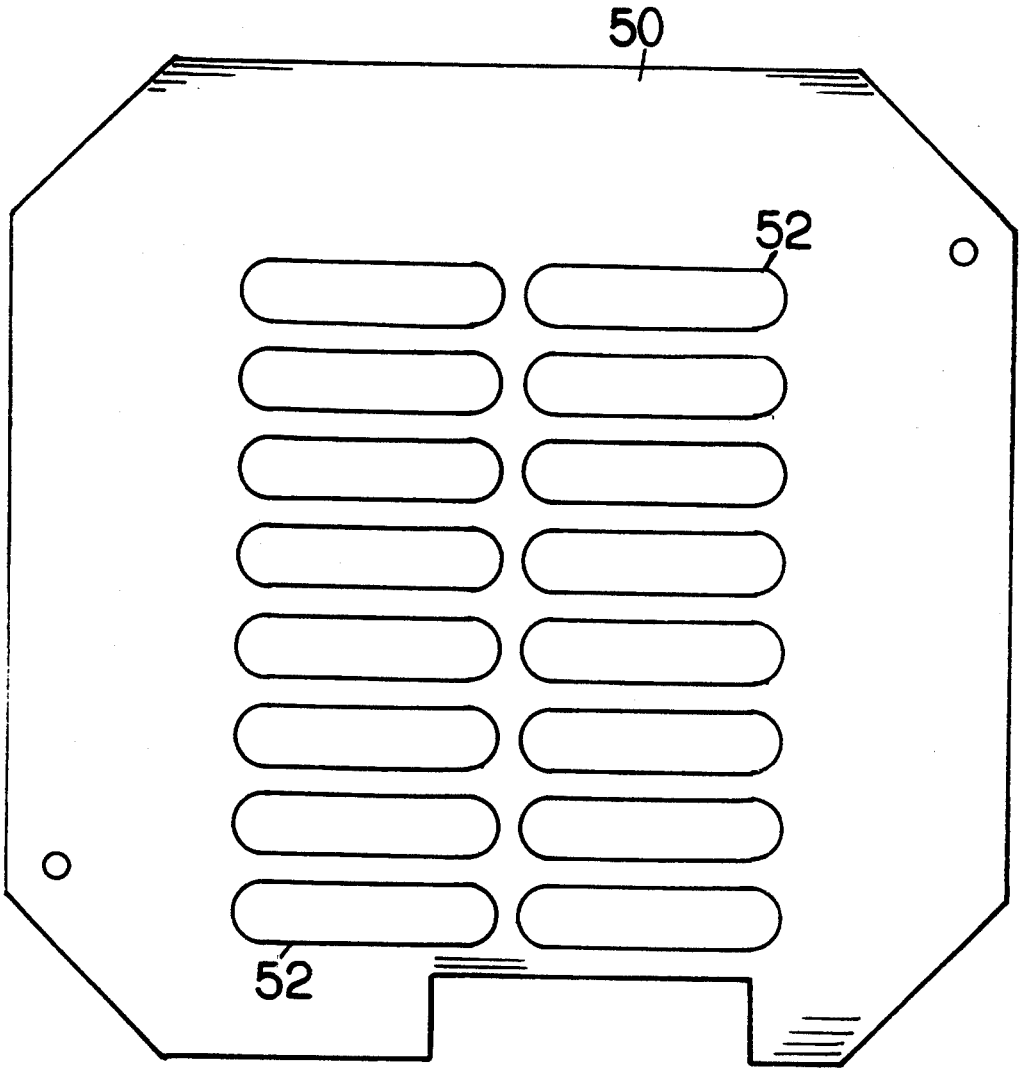
FIGS. 11 and 12 are plan views of apertured stationary plates located below the bin used in the dispenser of FIG. 1, including FIG. 11 illustrating a stationary plate having elongated slots for use in filling a conventional 30 or 31 pill or capsule blister package and FIG. 12 illustrating a stationary plate having apertures or openings arranged for filling a conventional 90 pill or capsule blister pack.
Figure 12:
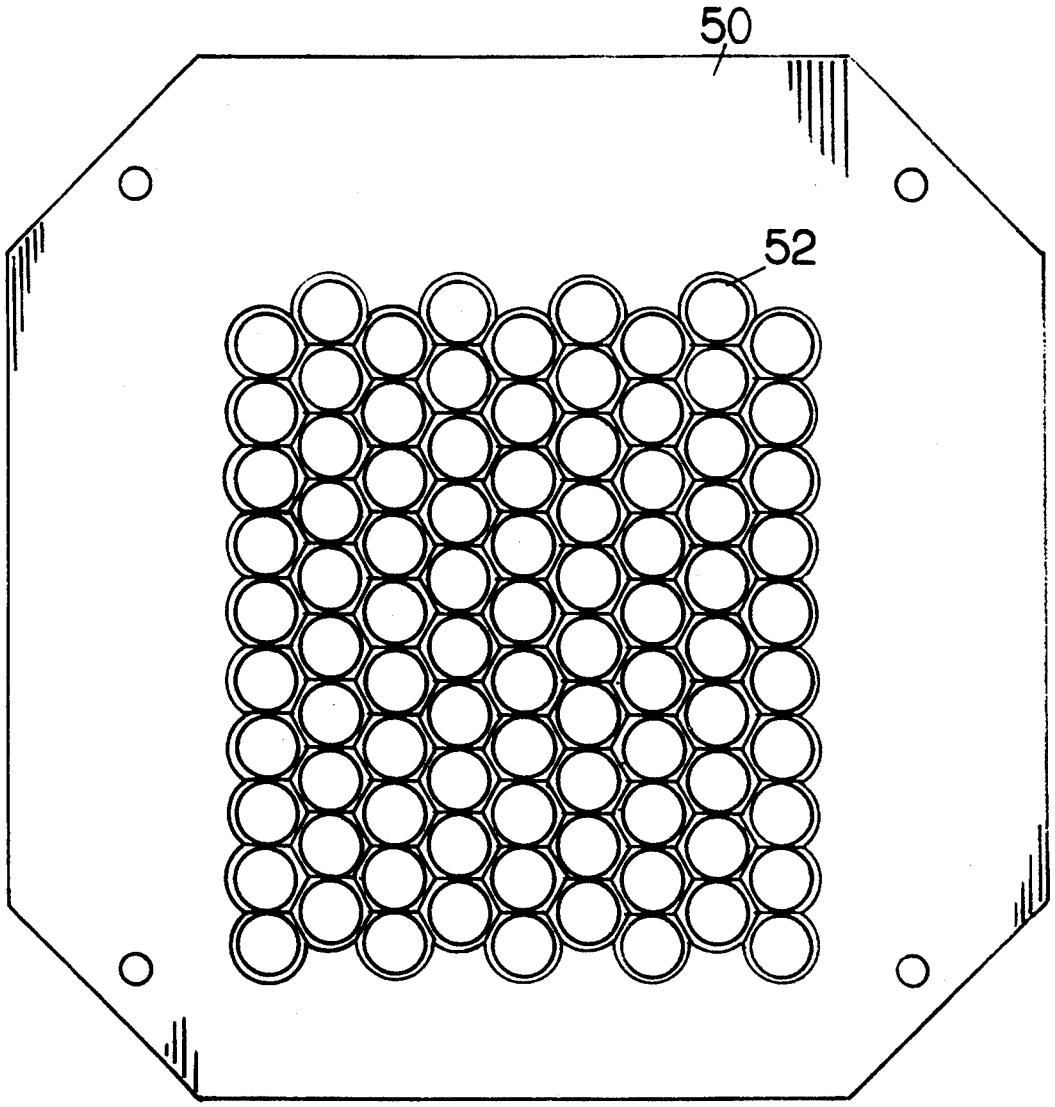

FIG. 11 illustrates a plate 50 with apertures 52 for ultimately dispensing pills or capsules into blister packages of either thirty (30) or thirty-one (31) openings. FIG. 12 shows a plate for use when the blister package has ninety (90) pills or capsules. It will be understood by one skilled in the art that the plate 50 is readily modified for use with the desired blister packages.

Figure 13:
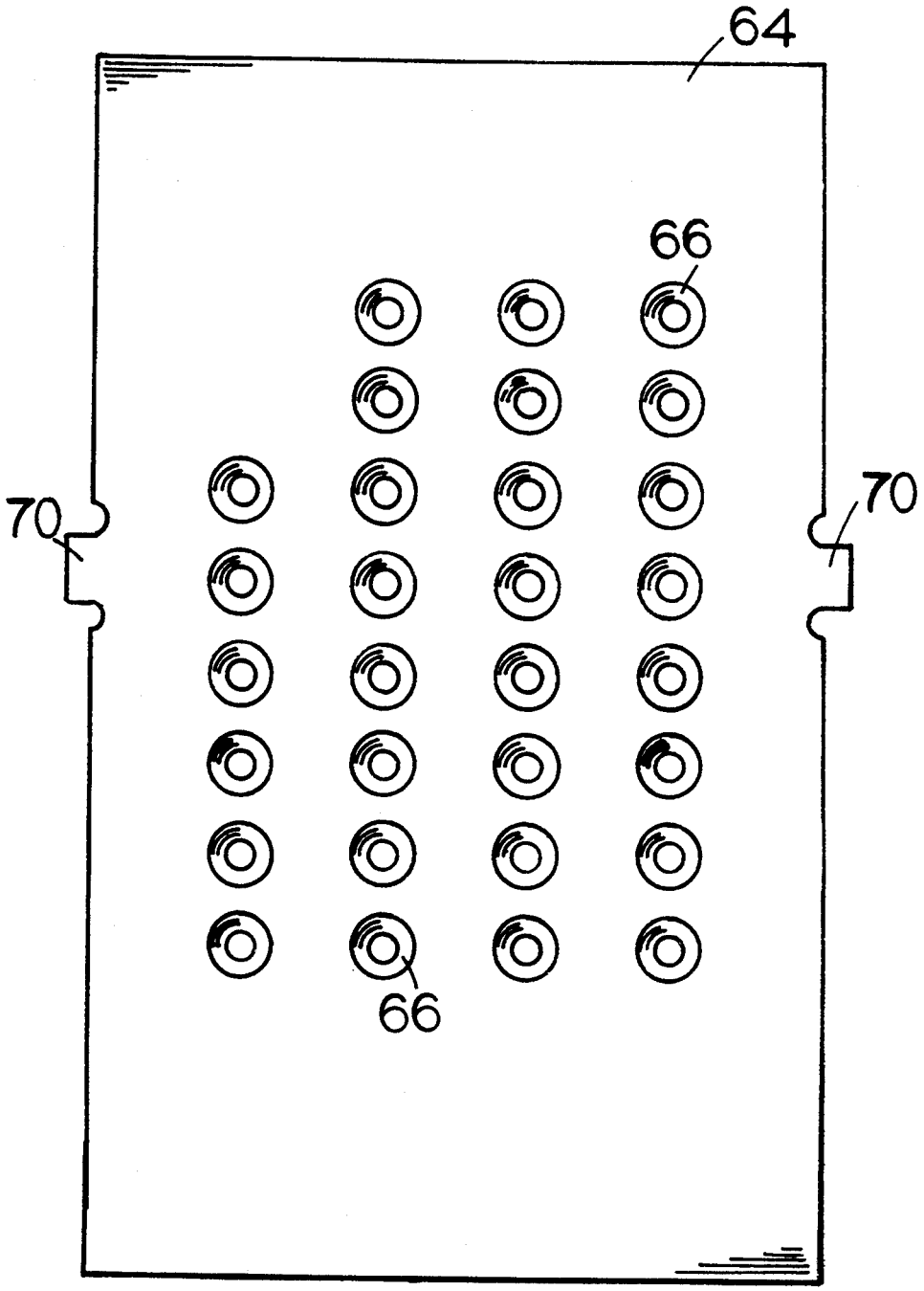
FIGS. 13, 14 and 15 are plan views of the shuttle apertured plate openings, used in the dispenser of the present invention depicted in FIG. 1 with FIG. 13 illustrating the pill or capsule shaped aperture for filling a conventional 30 pill or capsule blister package, FIG. 14 illustrating an apertured plate for filling a conventional blister package with 90 relatively small pills or capsules, and FIG. 15 illustrating an apertured plate for filling a conventional blister package with 90 relatively larger sized pills or capsules.
Figure 14:
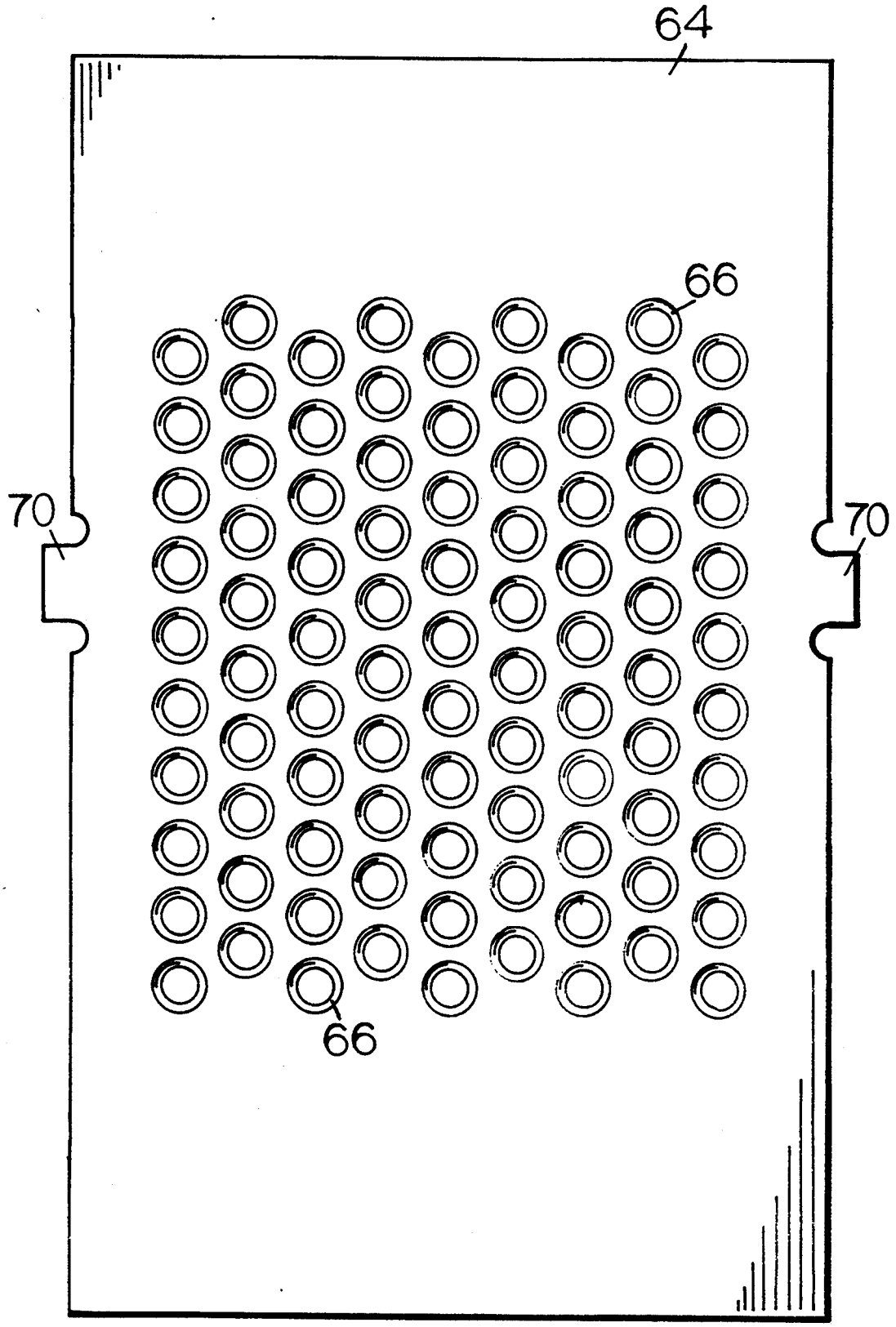
Figure 15:
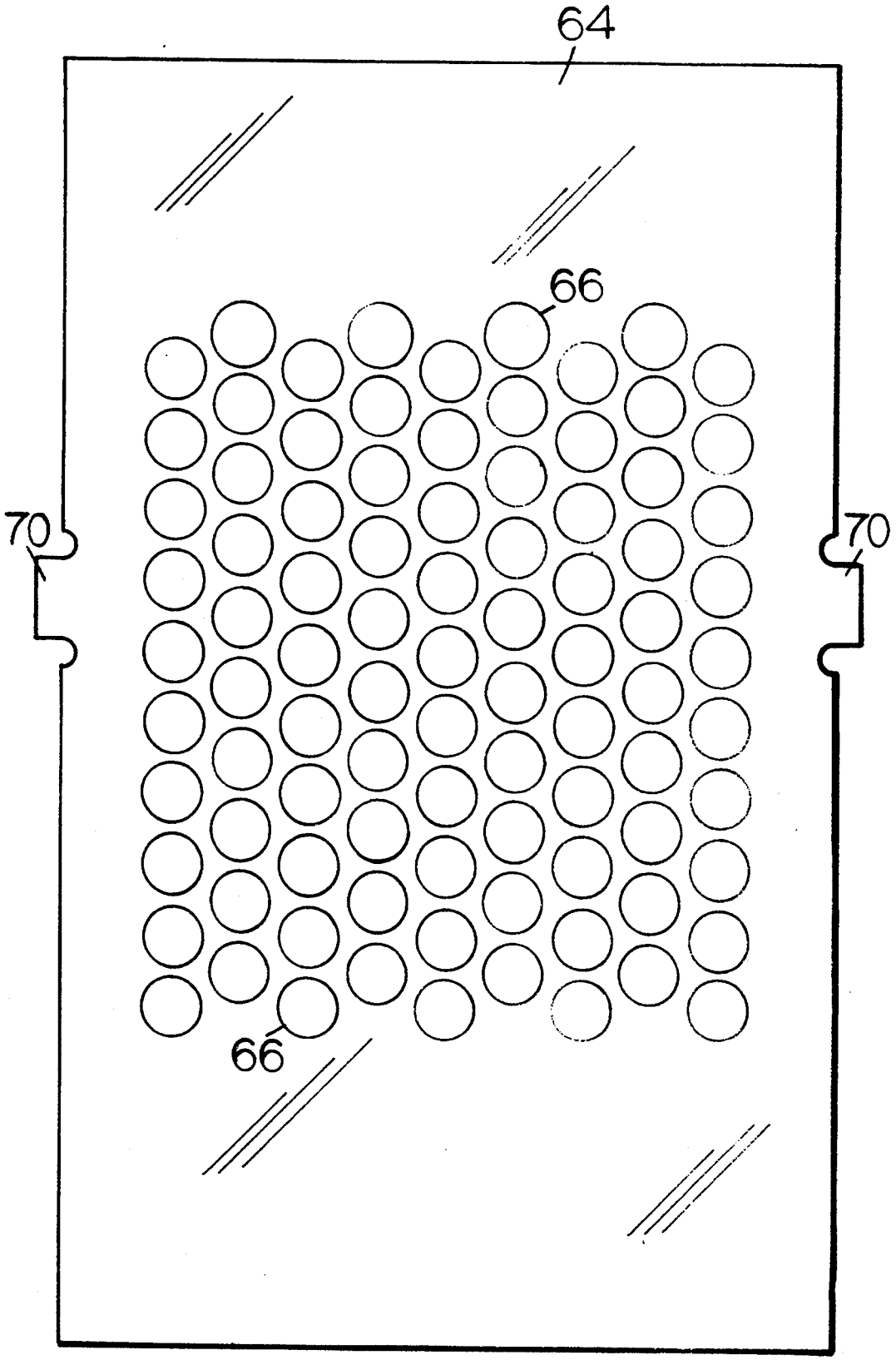

A shuttle plate 64 shown in FIG. 13, FIG. 14 and FIG. 15 has openings 66 generally corresponding to the size and/or thickness of the pills or capsules to be dispensed.

FIG. 13 generally illustrates a shuttle plate 64 used when filling blister packages of thirty (30) pills or capsules. It will be understood that this shuttle plate can be further modified to add another opening for use when filling blister packages of thirty-one (31) pills or capsules. FIG. 14 generally illustrates a shuttle plate 64 for use in filling blister packages of ninety (90) pills or capsules. FIG. 15 generally illustrates another embodiment of a shuttle plate 64 for use when filling blister packages of ninety (90) pills or capsules.

The shuttle plate 64 includes projections or ears 70 which fit into receiving notches 84, 86 of the recessed ledge 82. The projections or ears are of a width sufficiently less than the notches 84, 86 so as to allow movement of the shuttle plate 64 in a front-to-back horizontal direction.

Figure 16:
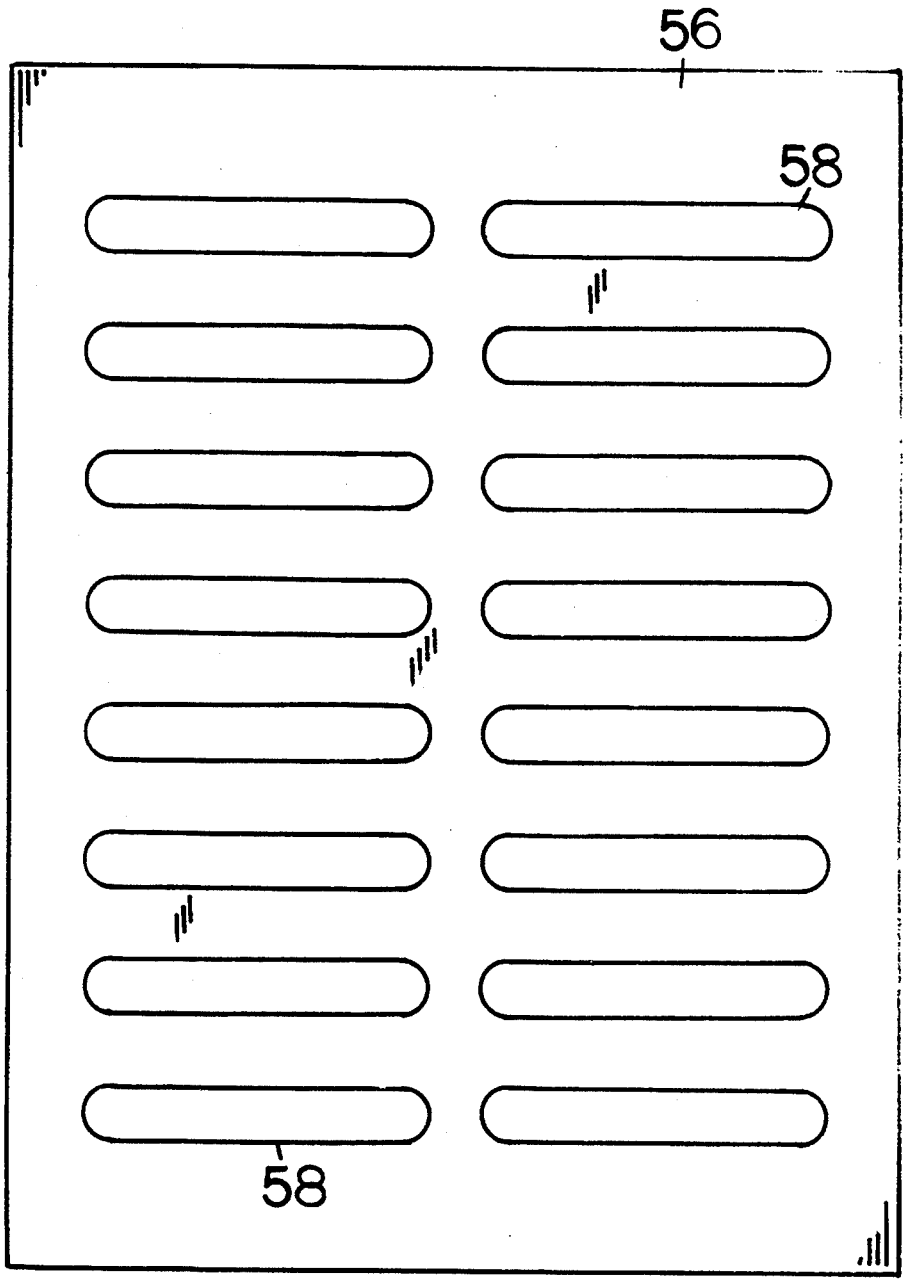
Figure 17:
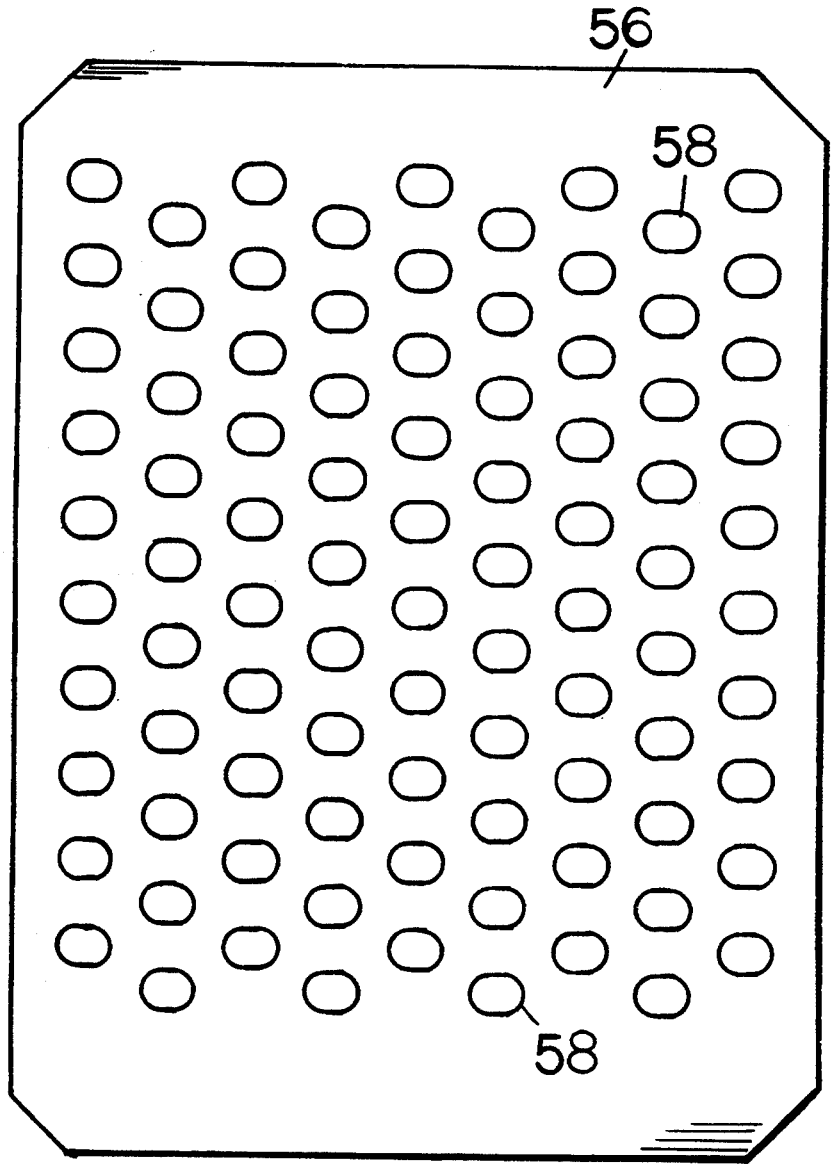
Figure 18:
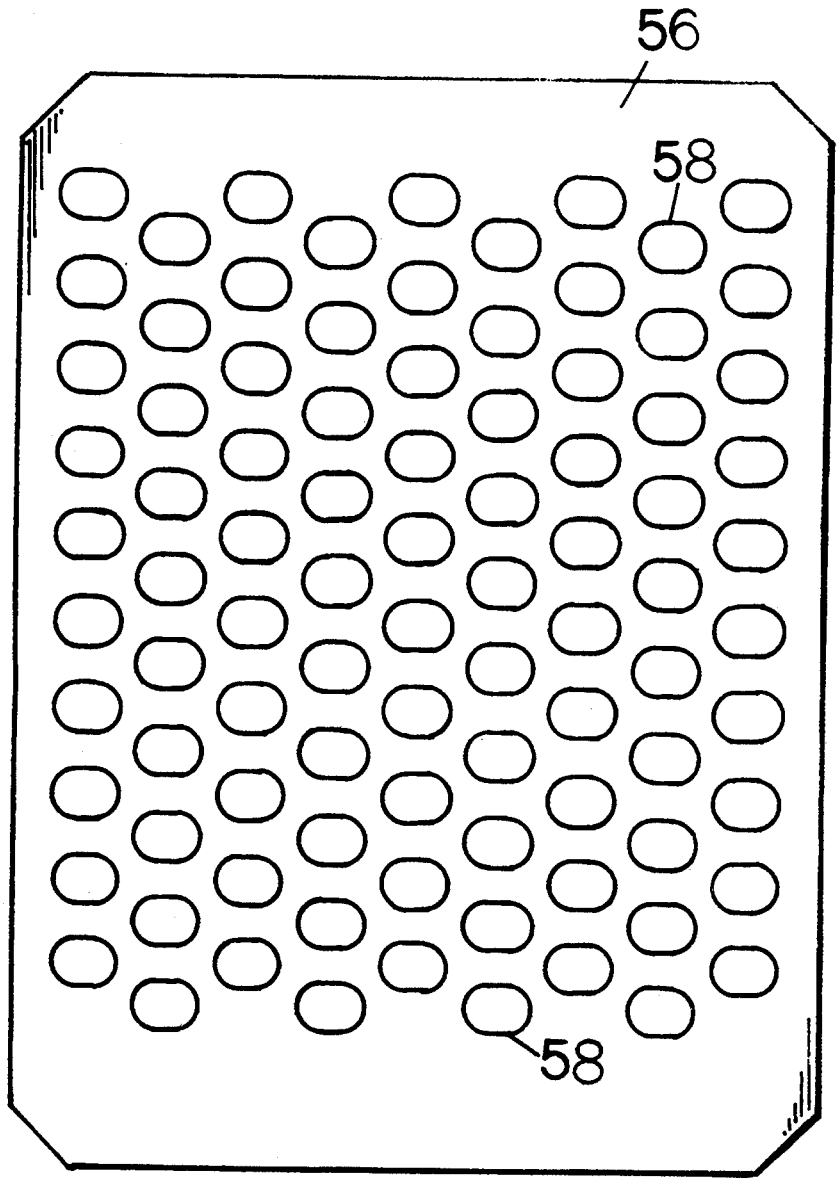

A dispensing plate 56, shown in FIGS. 16, 17 and 18, has apertures 58 corresponding generally to the shape of the pills or capsules being dispensed. The plate 56 of FIG. 16 is used when dispensing pills or capsules into blister packages of either thirty (30) or thirty-one (31) count, while the dispensing plates illustrated in FIGS. 17 and 18 are shown to illustrate the dispensing plates used when dispensing relatively smaller and larger pills or capsules into ninety (90) count blister packages.

Each dispensing plate 56 preferably includes a shoulder portion 92 along opposing outer side edges as generally illustrated in FIG. 19. When assembled the upper horizontal portion of each of the shoulder portions 92 are intended to rest on framing portion 90. This arrangement is one preferred embodiment for maintaining the desired alignment. It will be understood that other alignment arrangements are possible.

It will be understood from filling conventional blister packages or cards with conventional filling devices that the shape of the apertures of this and the other plates may vary without effecting the scope of the present invention.

It will be further understood that it would not be possible to illustrate every combination of number and size of holes. A particular arrangement can readily be formed when the size and number of pills or capsules and the blister package or card arrangement is known. Thus, one skilled in the art will now realize how the present invention can be readily adapted for as yet unknown pill or capsule size and number.

The fourth plate is a conventional paddle 76 as shown in FIG. 20. The paddle 76 supports a blister pack 78, including one or more molded blister package recesses 30 to be filled.

The plates are assembled as follows. Each blister pack 78 to be filled is positioned on its respective paddle 76 and the paddle is inserted. The paddle 76 is supported by the adjustable height work surface 28 of structure 10.

The dispensing plate 56 is positioned above the paddle 76, with its shoulders 92 resting in the notches 92 of framing portion 90. The height of the support structure 10 is then adjusted as described below to correspond to the thickness of the pills or capsules to be dispensed.

The shuttle plate 64 is positioned above the dispenser plate 56. The spring device 88 is mounted relative to the recessed ledge 82 and is depressed as the shuttle plate 64 is moved into place. The projections 70 are aligned with and fit into the notches 96 defined by the recessed ledge 82.

When the force used to depress the spring device 88 is released, the bias of the spring device 88 forces the shuttle plate 64 back toward the front of the dispenser 12. The movement or displacement of the shuttle plate 64 is limited by the interference between the edges of the notches 96 and the projections 70 located in the notches.

The upper plate 50 is then mounted on the U-shaped cover surface 14, between the cover surface 14 and the bin 16 which is held in place by tabs 15.

To dispense pills or capsules, the appropriate plates form a group of available plates that are selected and assembled as previously described. The distance between the work surface 28 supporting the dispensing plate 56 and the shuttle plate 64 is then adjusted to allow for the thickness of the plates and the size and shape of the pills or capsules being dispensed.

Without the aforementioned adjustment, the thickness of the particular adjacent plates chosen for the job and the thickness and/or shape and/or size of the pills or capsules intended to be dispensed could interfere with or even prevent the intended dispensing and filling of blister packages. Furthermore, this vertical height adjustment allows the apparatus of the present invention to be used for the same count but different size and/or shape pills or capsules to be dispensed with only the vertical height adjusted as taught herein.

The height of the support structure 10 is adjusted by turning the knob 46 on axle 42, the 1/32" increments in the height of work surface 28 corresponding to the standard variation in pill or capsule thickness. It will be understood that other increments and total adjustment may vary depending upon the application in which the present invention is used.

The bulk volume of the object to be dispensed is located in the collar bin 16. The rotation speed of the mixing rods 18 and brushes 20 is then selected when the mixing motor is turned on. The speed of the motor and brushes may be changed during the process if necessary to effect the movement of the pills or capsules within the bin 16.

The brushes then sweep the pills or capsules over the apertures or openings of the first plate 50, and gravity acts on the pills or capsules which then fall through the apertures 52 and into the apertures or openings 66 of the shuttle plate 64 when the shuttle plate is in a receiving position.

The shuttle plate 64 is then moved by applying a force against the spring mechanism. When the shuttle plate openings 66 are in vertical alignment with the dispensing plate 56 and its openings or apertures 58, then the pills or capsules fall through the dispensing plate 56 and into the molded recesses 30 of the blister package 78. The shuttle plate is then allowed to move back to its original biased position by the spring device.

The filled blister packages 78 in the paddle 76 are replaced with another un-filled blister packages 78, which can be accomplished by either replacing the blister package or the entire paddle 76 and blister package combination. A cover 80 is heat sealed over the blister package to complete the process.*

*On FIG. 20 we show a dotted line pill card with blister as being a side seam unit. Conventional blister packs are bottom seamed having ½ the card extending over the handle. (See original note attached to application executed by the inventors. JWK Oct. 13, 1993)

This is a brief summary of the operation of conventional dispensing apparatus as well as the apparatus of the present invention. The operation of the present invention is described below.

When a pill or capsule of a differing shape or thickness is to be dispensed, the appropriate plates are inserted and the work surface height adjusted correspondingly. The ability to adjust the height of the work surface as shown and described herein provides an efficient and time saving manner in which the pills or capsules of varying thicknesses and shapes are allowed to be dispensed by the same machine without completely dismantling or extensively modifying the dispenser 10.

From the foregoing description those skilled in the art will appreciate that all of the objects of the present invention are realized. A support structure is provided in which the height of the structure is easily varied. For the application disclosed herein the structure provides a surface work height that can be varied in 1/32" increments. The structure provided uses a minimum of parts, making the structure economical to produce and maintain.

The structure is suitable for use in combination with a solid object dispenser, and thereby provides a dispenser capable of being modified to dispense objects of various sizes and shapes without disassembly of the dispenser. When used in combination with a pill or capsule dispenser, the structure provides a dispenser capable of filling blister packs with pills or capsules of varying thicknesses by simply turning a knob.

While a specific embodiment has been shown and described, many variations are possible. The dispensing mechanism disclosed herein is preferred, but any suitable mechanism may be substituted. The 1/32" increments of height variation are presently useful in drug dispensing, but the height variations may be modified for the particular application. The combination dispenser is not limited to use with blister packs and may be used to fill any suitable container.

While the telescoping members which keep the work surface level are presently preferred, any suitable leveling means may be substituted.

The cam configuration disclosed is presently preferred, but any shape cam which provides proper height adjustment may be utilized. Further the structure should not be read as to be limited to the axle/pillow block construction disclosed herein. Any suitable indexing mechanism may be utilized to lock the cam in the desired position.

The pill or capsule dispensing method is described utilizing manual control of the axle position and the shuttle plate movement. Any or all portions of the method can be mechanized without departing from the applicant's invention.

Having described the invention in detail, those skilled in the art will appreciated that modifications may be made of the invention without departing from its spirit. Therefore, it is not intended that the scope of the invention be limited to the specific embodiment illustrated and described. Rather, it is intended that the scope of this invention be determined by the appended claims and their equivalents.

What is claimed is:

1. A variable height work surface apparatus for use in combination with a dispenser for dispensing pills or capsules into a conventional pill or capsule card or blister pack, the variable height work surface apparatus comprising:

a work surface to support a container into which one or more solid objects are to be dispensed;

an alignment means to maintain the work surface in level vertical alignment with a dispenser;

at least one asymmetric cam located below and supporting the work surface in horizontal position;

an axle to support the at least one asymmetric cam;

means to support the axle; and means to turn the at least one asymmetric cam, whereby upon turning the at least one asymmetric cam, a distance between the axle and the at least one asymmetric cam periphery is varied resulting in a corresponding variation of a height of the work surface.

2. A variable height apparatus as defined in claim 1 further including means to lock the at least one asymmetric cam in a selected position.

3. A variable height apparatus as defined in claim 1 wherein the alignment means includes telescoping members.

4. A variable height apparatus as defined in claim 1 wherein the at least one asymmetric cam has a radius which varies by at least one quarter inch.

5. A variable height apparatus as defined in claim 1 wherein the means to support the axle is at least one bearing member.

6. A variable height apparatus as defined in claim 1 wherein the means to turn the at least one asymmetric cam includes the combination of the axle and a knob suitable for turning the axle and the associated at least one asymmetric cam.

7. A variable height work surface apparatus for use in combination with a dispenser for dispensing pills or capsules into a conventional pill or capsule card or blister pack, the variable height work surface apparatus comprising:

a work surface to support a container into which the one or more solid objects are to be dispensed;

an alignment means to maintain the work surface in level vertical alignment with a dispenser;

at least one asymmetric cam located below and supporting the work surface in a generally horizontal position, the at least one asymmetric cam having a radius which varies by at least one quarter inch;

an axle to support the at least one asymmetric cam;

a pillow block to support the axle, a portion of the pillow block being adjacent to a face portion of the at least one asymmetric cam;

means to turn the at least one asymmetric cam to present varying cam radius lengths to the work surface; and means to lock the at least one asymmetric cam in position, whereby upon turning the at least one asymmetric cam a distance between the axle and the at least one asymmetric cam periphery is varied resulting in a corresponding variation of a height of the work surface.

8. A variable height apparatus as defined in claim 7 wherein the at least one asymmetric cam further includes radial portions corresponding to nine positions varying 1/32" from each other, so that the work surface height can be varied in 1/32" increments.

9. A variable height apparatus as defined in claim 7 wherein the work surface supports a fixed position paddle which holds containers to be filled in proper alignment with the dispenser.

10. An apparatus as defined in claim 7 wherein the means to turn the at least one asymmetric cam includes the axle extending beyond the work surface of the apparatus and a knob on the end of the axle.

11. An apparatus as defined in claim 7 wherein the means to lock the at least one asymmetric cam in position is an indexing device comprising a spring loaded ball bearing mounted in a portion of the pillow block adjacent to the face portion of the at least one asymmetric cam, and a plurality of semi-spherical recesses on the face portion of the at least one asymmetric cam.

12. An apparatus as defined in claim 7 wherein the pillow block further includes a portion which directly supports the at least one asymmetric cam.

13. A variable height work surface apparatus for use in combination with a dispenser for dispensing pills or capsules into a conventional pill or capsule card or blister pack, the variable height work surface apparatus comprising:

a work surface to support a container into which the one or more solid objects are to be dispensed, the work surface supports a fixed position paddle which holds containers to be filled in proper alignment with the dispenser;

an alignment means to maintain the work surface in level vertical alignment with the dispenser;

at least one asymmetric cam located below and supporting the work surface in horizontal position, the at least one asymmetric cam having a radius which varies by at least one quarter inch, the at least one asymmetric cam further including radial portions corresponding to nine discreet positions varying 1/32" from each other, so that the work surface height can be varied in 1/32" increments;

an axle to support the at least one asymmetric cam;

a pillow block to support the axle, the pillow block further including a portion which supports the at least one asymmetric cam directly;

means to turn the at least one asymmetric cam to present varying cam radius lengths to the work surface including the axle extending beyond the work surface of the apparatus and a knob on the end of the axle; and means to lock the at least one asymmetric cam in position, whereby upon turning the at least one asymmetric cam a distance between the axle and the at least one asymmetric cam periphery is varied resulting in a corresponding variation of a height of the work surface.

14. A method of dispensing a pill or capsule into a conventional pill or capsule card or blister pack, the method comprising the steps of:

supporting a variable height work surface with an asymmetrical cam;

determining the size and thickness of the pill or capsules to be dispensed;

configuring the dispenser to dispense pills or capsules of the determined size;

rotating the asymmetrical cam to vary the height of the work surface;

positioning the work surface in vertical alignment with the pill or capsule dispenser to correspond to the determined thickness of the pill or capsule to be dispensed;

locking the asymmetrical cam in the desired position;

levelling the work surface;

inserting a conventional pill or capsule card or blister pack to be filled; and dispensing the pills or capsules into the conventional pill or capsule card or blister pack to be filled.

15. A method as set forth in claim 14 further comprising the step of dispensing the pills or capsules by moving a shuttle from a pill or capsule receiving position to a pill or capsule dispensing position.

16. A method as set forth in claim 15 further comprising the step of feeding the pill or capsule into a shuttle pill or capsule receiving opening by gravity.

17. A method as set forth in claim 16 further comprising the step of transferring the pill or capsule into registration with dispenser plate which is in turn in registration with the conventional pill or capsule card or blister pack.

18. A method as set forth in claim 17 further comprising the step of positioning the work surface by adjusting the distance between the shuttle and the dispenser plate.

19. A method as set forth in claim 18 further comprising the step of removing a filled conventional pill or capsule card or blister pack from the variable height work surface and inserting the filled conventional pill or capsule card or blister pack into means for heat sealing the filled conventional pill or capsule card or blister pack so as to seal the pills or capsules within their respective receptacles that are provided in the conventional pill or capsule card or blister pack.

* * * * *